US007534095B2

(12) United States Patent
Climenhaga et al.

(10) Patent No.: US 7,534,095 B2
(45) Date of Patent: May 19, 2009

(54) CONDENSATE SCAVENGING SYSTEM AND METHOD FOR IN-GROUND VEHICLE LIFTS

(75) Inventors: Douglas W. Climenhaga, Sycamore, IL (US); Thomas F. Leahy, St. Charles, IL (US)

(73) Assignee: SVI International, Inc., Aurora, IL (US)

( * ) Notice: Subject to any disclaimer, the term of this patent is extended or adjusted under 35 U.S.C. 154(b) by 578 days.

(21) Appl. No.: 11/063,089

(22) Filed: Feb. 22, 2005

(65) Prior Publication Data

US 2006/0222521 A1 Oct. 5, 2006

(51) Int. Cl.
*F04B 49/00* (2006.01)
*B66F 7/00* (2006.01)

(52) U.S. Cl. ..... 417/1; 187/203

(58) Field of Classification Search ..... 187/203, 187/205, 215, 206, 207; 417/1, 36, 38, 313, 417/395; 92/86; 60/455
See application file for complete search history.

(56) References Cited

U.S. PATENT DOCUMENTS 3,334,706 A * 8/1967 Dayson ..... 187/203
5,613,420 A * 3/1997 Glockemann ..... 91/404
5,669,764 A * 9/1997 Behringer et al. ..... 417/395
6,571,919 B1 * 6/2003 Stewart ..... 187/215

* cited by examiner

*Primary Examiner*—Devon C Kramer
*Assistant Examiner*—Alexander B Comley
(74) *Attorney, Agent, or Firm*—Wood, Phillips, Katz, Clark & Mortimer

(57) ABSTRACT

An in-ground lift (10) is provided with a condensate scavenging system (30) that includes a pump (32) and a control (34) that is connected to the pump (32) and configured to selectively switch the pump (32) between a non-pumping state wherein the pump (32) is inactive and a pumping state wherein the pump (32) is expelling condensate from the base structure (12) of the lift (10). It is preferred that the control (34) be configured so that the pump (32) automatically switches between the non-pumping state and the pumping state in response to a predetermined change of state in the in-ground vehicle lift (10).

13 Claims, 2 Drawing Sheets

CONDENSATE SCAVENGING SYSTEM AND METHOD FOR IN-GROUND VEHICLE LIFTS

FIELD OF THE INVENTION

This invention relates to vehicle lifts and, more particularly to in-ground vehicle lifts such as in-ground cassette lifts, in-ground high pressure lift cylinder tubes, in-ground side-by-side lift equalizer tubes, or in-ground continuous pit truck and buss movable piston axle engaging type lifts.

BACKGROUND OF THE INVENTION

One problem associated with in-ground vehicle lifts is condensate that collects in the base structure of the lifts. Typically, this condensate is generated every time the lift is cycled up and down, which draws fresh air and the moisture contained therein into the base structure of the lift. Condensate then forms when the air contacts the cool surfaces in the base structure of the lift. If it is not removed from the base structure, the condensate will typically cause corrosion, potentially severe, of the various components of the vehicle lift. Such corrosion is a continuing problem at vehicle service centers that employ in-ground lifts because it causes failures in operation of the lifts, downtime, and costly repairs.

One known approach for removing the condensate is a cart based system that can be manually moved from one lift to the next. The cart includes a venturi pump that operates off of the service center's compressed air supply. An inlet to the pump is manually connected to a condensate collection location in the base structure of the lift and the pump is then activated to remove or scavenge the condensate from the base structure. After the condensate has been removed from one lift, the cart can be manually moved to another lift and the sequence repeated. While this approach may work, it is labor intensive and requires a regular maintenance schedule to insure that the condensate is periodically removed from each in-ground lift of the service center before the condensate can produce undesirable amounts of corrosion.

Thus, there is a continuing need to provide an improved system for removing condensate from in-ground vehicle lifts.

SUMMARY OF THE INVENTION

In accordance with one feature of the invention, a system is provided to remove condensate from the base structure of an in-ground vehicle lift. The system includes a pump, with the pump including a condensate inlet operably connected to a condensate collection location in the base structure, and a condensate outlet to direct the condensate from the base structure. The pump has a non-pumping state and a pumping state.

According to one feature of the invention, a condensate scavenging, in-ground vehicle lift is provided and includes a base structure for in-ground installation; at least one lift cylinder mounted in the base structure; and a pump including a condensate inlet operably connected to a condensate collection location in the base structure, and a condensate outlet to direct the condensate from the base structure. The pump having a non-pumping state and a pumping state.

As one feature, the pump is configured to switch automatically between the non-pumping and pumping states in response to a pre-determined change of state in the in-ground vehicle lift.

In one feature, a control is connected to the pump and configured to selectively switch the pump between the non-pumping and pumping states.

According to one feature, the pump is an air operated diaphragm pump. In a further feature, the pump includes an air inlet connected to a compressed air line of the in-ground vehicle lift. In yet a further feature, the air inlet is connected to an air line that supplies compressed air to a compressed air powered safety lock of the in-ground vehicle lift.

In one feature, the control includes a manual air valve.

In accordance with one feature, the control includes an air valve that is configured to supply compressed air to the pump in response to at least one of a timer and a predetermined change of state in the in-ground vehicle lift.

In accordance with one feature of the invention, a method is provided for removing condensate from an in-ground vehicle lift. The method includes the steps of collecting condensate at a location within the lift; and automatically removing the condensate from the lift in response to a pre-determined change of state in the lift.

According to one feature, the step of automatically removing includes activating a pump in response to the change of state in the lift.

In one feature, the step of automatically removing includes removing the condensate in response to the lift moving between a raised and a lowered position.

In accordance with one feature, the step of automatically removing includes removing the condensate in response to release of a safety lock mechanism in the lift.

As one feature, the step of automatically removing includes powering a pump using bleed air from a compressed air line in the lift.

Other objects, features, and advantages of the invention will become apparent from a review of the entire specification, including the appended claims and drawings.

DETAILED DESCRIPTION OF THE PREFERRED EMBODIMENT

Figure 1:
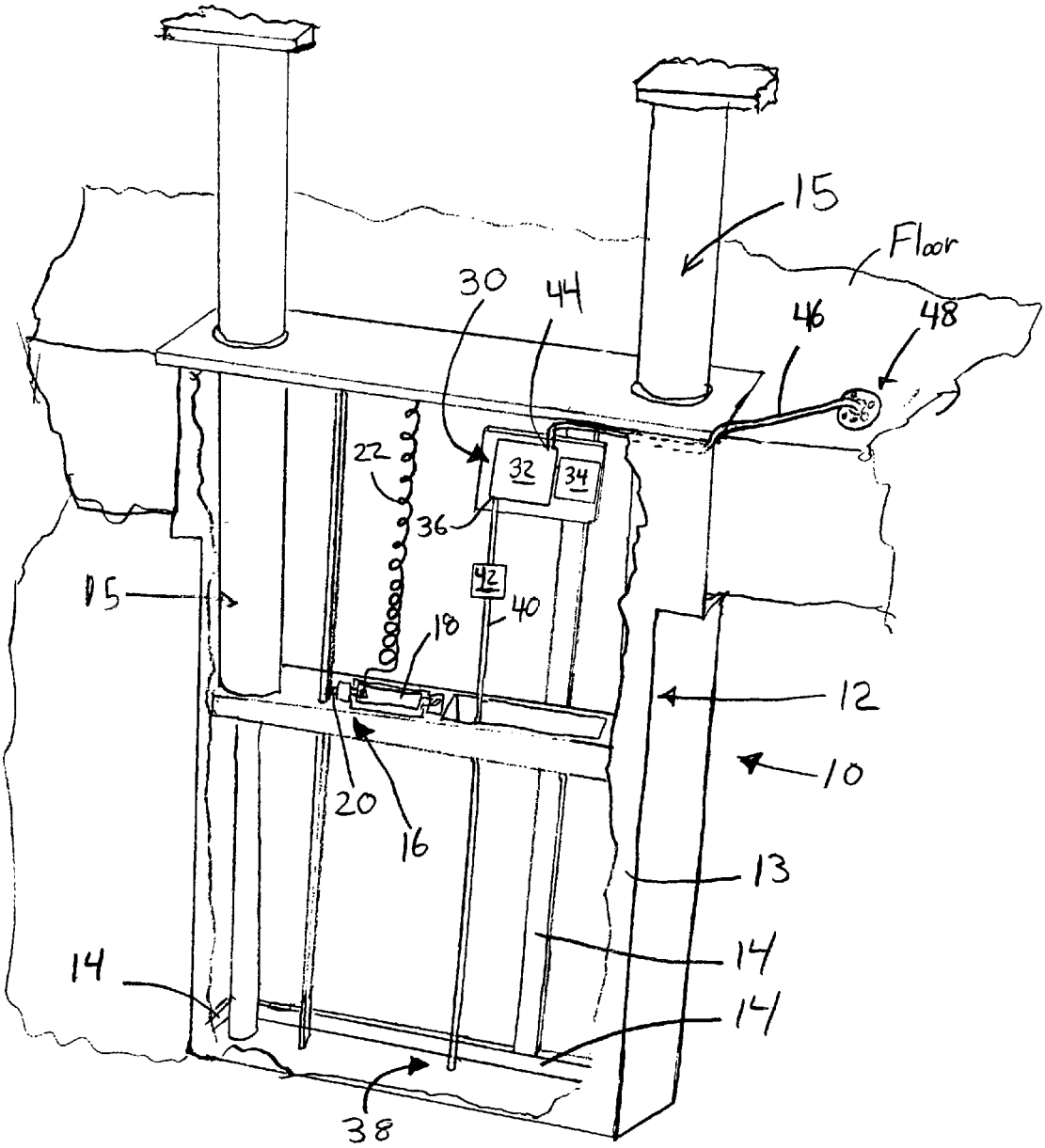
FIG. 1 is a somewhat diagrammatic, broken perspective view of an in-ground vehicle lift including a condensate scavenging system embodying the invention.

One example of an in-ground vehicle lift is shown in FIG. 1 in the form of a in-ground cassette lift 10. The lift 10 includes a base structure or frame 12 that is received in a conforming pit that is formed into the floor of the vehicle service center that utilizes the lift 10. The base structure 12 typically includes a case or housing structure 13 and structural frame members 14 that mount the components of the lift 10, including one or more hydraulic lift cylinders 15, a pneumatically actuated safety lock mechanism, shown somewhat diagrammatically at 16, which includes a pneumatic cylinder 18 that actuates a safety latch 20, and a compressed air line 22 for selectively supplying air to the cylinder 18 to disengage the safety latch 20 when the lift 10 is to be lowered. Because the specific details of the lift 10 and its components are not critical to an understanding of the invention, and further because there are many well known types and constructions for in-ground vehicle lifts, further description of the details of the lift 10 will not be provided herein.

The location of the base structure 12 below ground level makes the base structure a natural location to gather water, particularly in the form of condensate which is generated by the operation of the lift cylinders 15. This condensation tends to gather at the bottom of the base structure 12 and can easily build up over time to a significant depth in the base structure 12. If the condensate is not regularly scavenged or removed from the base structure 12, the components of the lift 10 will be in an environment that is constantly moist or humid, which results in corrosion of the components, including the frame members 14.

To overcome this problem, the lift 10 is provided with a condensate scavenging system, shown diagrammatically at 30, that includes a pump 32 and a control 34 that is connected to the pump 32 and configured to selectively switch the pump 32 between a non-pumping state wherein the pump 32 is inactive and a pumping state wherein the pump 32 is expelling condensate from the base structure 12. In this regard, it is preferred that the control 34 be configured so that the pump 32 automatically switches between the non-pumping state and the pumping state in response to a predetermined change of state in the in-ground vehicle lift 10. However, in some application it may be desirable for the control 34 to be configured so the pump 32 can be manually switched between the non-pumping and pumping states.

The pump 32 includes a condensate inlet 36 operably connected to a location 38 in the base structure 12 where the condensate collects, which will typically be the bottom of the base structure 12. This connection is preferably made by a suitable water or condensate conduit 40, such as for example, rubber or PVC tubing, that extends from the inlet 36 to the location 38. Preferably, an in-line pump strainer or filter 42 is provided somewhere in the conduit 40 between the location 38 and the inlet 36 in order to remove debris from the condensate that could foul the pump 32. The pump 32 also includes a condensate outlet 44 to direct the condensate from the base structure 12, typically via another suitable water or condensate conduit 46 that is connected to the outlet 44 and extends therefrom to a location 48, such as a drain or a collection receptacle (bucket), that is external or remote from the base structure 12.

The pump 32 can be of any suitable type, and is preferably self-priming for the amount of water lift (vertical distance from the condensate collection location 38 to the pump 32) required for the particular type of in-ground vehicle lift in which the system 30 is employed. For example, in-ground cassette lifts can require about 8 to 9 feet of lift for the condensate. Some examples of pumps that are capable of providing adequate self-priming lift include diaphragm pumps, self-priming centrifugal pumps, and venturi pumps.

Figure 2:
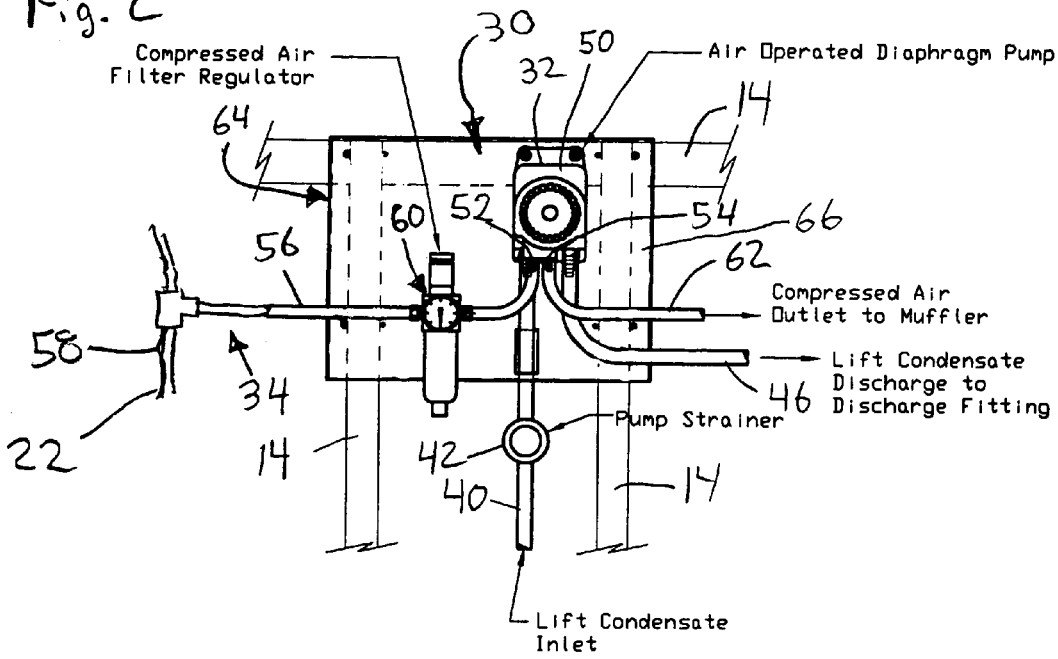
FIG. 2 is a front elevation of a preferred form of the condensate scavenging system of FIG. 1.
Figure 3:
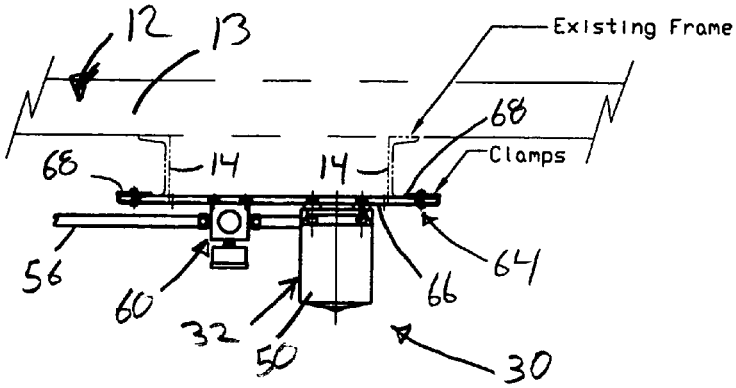
FIG. 3 is a view taken from line 2-2 in FIG. 2.

With reference to FIGS. 2-3, one highly preferred embodiment of the system 30 is shown wherein the pump 32 is provided in the form of an air operated (pneumatic) diaphragm pump 50 that includes an air inlet 52 and an air outlet 54. While any suitable, available air supply can be used, it is preferred that the air inlet be connected by a suitable air bleed line or conduit 56 to a compressed air line 58 that is part of the lift 10 and provides compressed air for one or more other components of the lift 10. Because the volume of air flow required by the diaphragm pump 50 is relatively minor, a suitable air flow to operate the pump 50 can be bleed from the compressed air line 58 with out negatively impacting the rest of the air system of the lift 10. In this regard, it is highly preferred that the air line 58 be the air line 22 that supplies compressed air to the safety lock mechanism 16. By bleeding the operating air for the pump 50 from the air line 22, the pump 50 will automatically be switched from its non-pumping state to its pumping state every time the lift 10 is lowered (a change of state), which means that the pump 50 will be activated every time the lift 10 undergoes a condensate generating cycle, thereby providing adequate scavenging of the condensate from the lift 10. In this configuration, the control 34 takes the form of the bleed line 56 connected to the air line 22, thereby providing a very simple and low cost solution.

Other suitable forms for the control 34 include a manual air valve that can be selectively operated to switch the pump 50 between states; an electric solenoid air valve in conjunction with an electrical push button, limit switch, lever switch, float switch, or timer; or an air pilot actuated valve in conjunction with a pneumatic push button, limit switch, lever switch, float switch, or timer. When a push button, limit switch, or lever switch is employed, it can be configured with one of the movable component of the lift 10 so that the switch is actuated in response to the pre-determined motion of the component when the lift 10 changes states, thereby providing automatic switching of the pump 50 between the non-pumping and pumping states. When a float switch is used, the pump 50 will automatically switch from the non-operating state to the operating state in response to the condensate accumulating to a pre-determined vertical level in the base structure 12, which accumulation can be considered a change of state of the lift 10. When a timer is used, the pump 50 will automatically switch from the non-operating state to the operating state in response to a pre-determined time period, which time period would not be considered a change of state of the lift 10.

It should be understood that in some applications it may be desirable to provide the control 34 so that it can activate the pump in more than one way. For example, it could be desirable in some applications to provide a manually operated valve or switch in conjunction with one of the automatic forms previously discussed to allow for occasional manual operation of the pump 32.

Preferably, a suitable compressed air filter/regulator 60 is located along the air line 56 upstream from the air inlet 52 and downstream from the air line 58 to filter debris from the air flow and regulate the pressure of the air flow. It is also preferred that the air outlet 54 be operably connected by an air conduit or line 62 to a suitable compressed air muffler, preferable the air muffler for the service centers compressed air supply.

Figure 4:
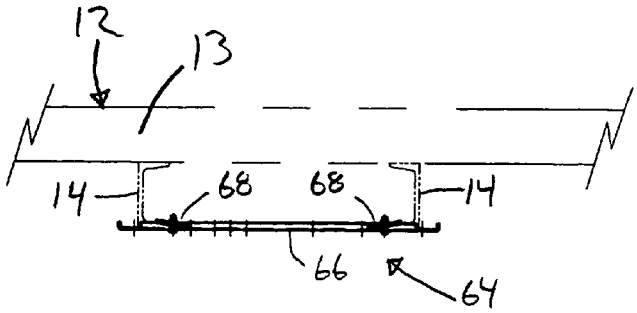
FIG. 4 is a view similar to FIG. 3, but showing an alternate arrangement for a mount bracket.

Preferably, the system 30 is mounted within the base structure 12 of the lift 10. In this regard, a system mount bracket 64 is preferable provided for mounting the pump 50 and the air filter/regulator 60 to one or more of the frame members 14. As best seen in FIG. 3, the bracket 64 of the illustrated embodiment includes a base plate 66 and bolt tightened clamps 68 for securing the plate 66 to the frame members 14. FIG. 4 shows an alternate location for the clamps 68 that can accommodate a different orientation of the frame members 14. It should be understood that the details of the mount bracket 64 will be highly dependent upon the particular configuration of the frame members 14 of each particular lift 10.

While the pump 32 has been described in a preferred embodiment as the air operated diaphragm pump 50, it should be understood that in some types of lifts or in certain vehicle service centers, it may be desirable to use other types of suitable pumps, examples of which were previously discussed herein. In this regard, it should also be understood that the previously described forms for the control 34 would be adapted to conform with the particular type of pump selected.

The system 30 can be supplied preassembled in an in-ground vehicle lift when the lift is originally delivered for installation at a service center, or the system 30 can be supplied as a kit to the service center for installation in connection with in-ground vehicle lifts that have already been installed at the service center. In this regard, the use of such a kit would allow for the system 30 to be installed in existing in-ground vehicle lifts which are currently suffering from the corrosion associated with un-scavenged condensate.

While it is preferred to mount the system 30 within the lift 10, it should be understood that in some applications it may be desirable to mount the system 30 externally or remote from the lift 10, with a suitable conduit connection to the condensate collection location 38. Additionally, it may also be desirable in some applications, particularly those where the system 30 is mounted remote from the lift 10, to power the pump 32 using a source independent from the lift 10, such as by using the shop air of the service center if using an air operated pump, or shop electric supply if using an electric motor driven pump.

The invention claimed is:

1. A system to remove condensate from a base structure of an in-ground vehicle lift, the system comprising:

a pump including a condensate inlet operably connected to a condensate collection location in the base structure, and a condensate outlet to direct the condensate from the base structure, the pump having a non-pumping state and a pumping state, the pump configured to switch automatically between the non-pumping and pumping states in response to a pre-determined change of state in the in-ground vehicle lift;

wherein said pump is an air operated diaphragm pump; and wherein said pump comprises an air inlet, the air inlet connected to a compressed air line of said in-ground vehicle lift.

2. The system of claim 1 wherein said air inlet is connected to an air line that supplies compressed air to a compressed air powered safety lock of the in-ground vehicle lift.

3. The system of claim 1 further comprising a compressed air filter regulator connected upstream of the air inlet and downstream from the compressed air line.

4. A system to remove condensate from a base structure of an in-ground vehicle lift, the system comprising:

a pump including a condensate inlet operably connected to a condensate collection location in the base structure, and a condensate outlet to direct the condensate from the base structure, the pump having a non-pumping state and a pumping state; and a control connected to the pump and configured to selectively switch the pump between the non-pumping and pumping states;

wherein said pump is an air operated diaphragm pump; and wherein said pump comprises an air inlet, the air inlet connected to a compressed air line of said in-ground vehicle lift.

5. The system of claim 4 wherein said control comprises a compressed air line that supplies compressed air to a compressed air powered safety lock of the in-ground vehicle lift.

6. The system of claim 4 wherein said control comprises a manual air valve.

7. The system of claim 4 wherein said control comprises an air valve that is configured to supply compressed air to the pump in response to at least one of a timer and a predetermined change of state in the in-ground vehicle lift.

8. The system of claim 7 wherein said air valve is an electric solenoid valve.

9. The system of claim 7 wherein said air valve is a pilot actuated air valve.

10. A condensate scavenging, in-ground vehicle lift comprising:

a base structure for in-ground installation;

at least one lift cylinder mounted in the base structure; and a pump including a condensate inlet operably connected to a condensate collection location in the base structure, and a condensate outlet to direct the condensate from the base structure, the pump having a non-pumping state and a pumping state, the pump configured to switch automatically between the non-pumping and pumping states in response to a pre-determined change of state in the in-ground vehicle lift;

wherein said pump is an air operated diaphragm pump; and further comprising a compressed air line; and wherein said pump comprises an air inlet connected to the compressed air line.

11. The system of claim 10 further comprising a compressed air powered safety lock connected to the compressed air line to receive compressed air therefrom.

12. A condensate scavenging, in-ground vehicle lift comprising:

a base structure for in-ground installation;

at least one lift cylinder mounted in the base structure;

a pump including a condensate inlet operably connected to a condensate collection location in the base structure, and a condensate outlet to direct the condensate from the base structure, the pump having a non-pumping state and a pumping state; and a control connected to the pump and configured to selectively switch the pump between the non-pumping and pumping states;

wherein said pump is an air operated diaphragm pump; and further comprising a compressed air line, and wherein said pump comprises an air inlet, the air inlet connected to the compressed air line.

13. The in-ground vehicle lift of claim 12 further comprising a compressed air powered safety lock connected to the compressed air line to receive compressed air therefrom.

* * * * *